US009349334B2

(12) United States Patent
Xu et al.

(10) Patent No.: US 9,349,334 B2
(45) Date of Patent: May 24, 2016

(54) POLARITY INVERSION SIGNAL CONVERTING METHOD, APPARATUS AND DISPLAY

(71) Applicants: BOE TECHNOLOGY GROUP CO., LTD., Beijing (CN); BEIJING BOE DISPLAY TECHNOLOGY CO., LTD., Beijing (CN)

(72) Inventors: Yizhen Xu, Beijing (CN); Weihai Li, Beijing (CN); Zhihua Sun, Beijing (CN); Jianming Wang, Beijing (CN); Liang Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 305 days.

(21) Appl. No.: 13/953,279

(22) Filed: Jul. 29, 2013

(65) Prior Publication Data

US 2014/0036184 A1 Feb. 6, 2014

(30) Foreign Application Priority Data

Aug. 3, 2012 (CN) ..... 2012 1 0275427

(51) Int. Cl.
*G09G 5/00* (2006.01)
*G09G 3/36* (2006.01)

(52) U.S. Cl.
CPC ..... *G09G 3/3614* (2013.01)

(58) Field of Classification Search
None
See application file for complete search history.

(56) References Cited

U.S. PATENT DOCUMENTS

| | | | | |
|---|---|---|---|---|
| 2005/0146490 | A1* | 7/2005 | Kang et al. | 345/76 |
| 2009/0002291 | A1 | 1/2009 | Koo et al. | |
| 2011/0134092 | A1 | 6/2011 | Lee et al. | |
| 2011/0164076 | A1* | 7/2011 | Lee | 345/691 |
| 2012/0013591 | A1 | 1/2012 | Kim et al. | |

FOREIGN PATENT DOCUMENTS

| | | | |
|---|---|---|---|
| CN | 101334972 | A | 12/2008 |
| CN | 102339591 | A | 2/2012 |
| KR | 20110064230 | A | 6/2011 |
| TW | 201209793 | A | 3/2012 |

OTHER PUBLICATIONS

Second Chinese Office Action dated May 28, 2014; Appln. No. 201210275427.3.
Chinese Rejection Decision Appln. No. 201210275427.3; Dated Nov. 27, 2014.
First Chinese Office Action dated Sep. 18, 2013; Appln. No. 201210275427.3.

* cited by examiner

*Primary Examiner* — Adam R Giesy
(74) *Attorney, Agent, or Firm* — Ladas & Parry LLP

(57) ABSTRACT

The present disclosure provides a polarity inversion signal converting method, a polarity inversion signal converting apparatus and a display, the polarity inversion signal converting method comprises: judging whether a polarity inversion signal is required to be converted currently and generating a judgment result; changing the polarity inversion signal currently output to a data driver, if the judgment result indicates that the polarity inversion signal is required to be converted currently. With the present disclosure, the polarity inversion signal output to the data driver may be changed according to different situations, so that the driving manners of the data driver may vary flexibly.

10 Claims, 6 Drawing Sheets

POLARITY INVERSION SIGNAL CONVERTING METHOD, APPARATUS AND DISPLAY

FIELD OF THE INVENTION

The present disclosure relates to a field of display technique, and particularly to a polarity inversion signal converting method, a polarity inversion signal converting apparatus and a display.

BACKGROUND

Liquid crystal molecules in a liquid crystal display has a characteristic that the liquid crystal molecule may not deflect in response to a change of electrical field to form different brightness, if the characteristic of the liquid crystal molecule has be destroyed because a pixel voltage applied on a pixel electrode always remains being unchanged. In order to avoid the above situation, the pixel voltage is generally divided into two polarities (a positive polarity and a negative polarity) in the prior art, wherein the voltage at the pixel electrode being higher than a voltage at a common electrode is referred as having the positive polarity, and the voltage at the pixel electrode being lower than the voltage at the common electrode is referred as having the negative polarity. A deflection direction of the liquid crystal molecule may be changed by changing the positive-negative polarity of the pixel voltage alternatively, in order to protect the liquid crystal molecule.

As illustrated in FIG. 1, which is an exemplary view illustrating a structure of a driving circuit of a liquid crystal display panel in the prior art, the driving circuit at least comprises a timing controller (TCON) and a data driver (Source Driver), wherein the timing controller may provide to the data driver a polarity inversion signal (POL) and digital video signals, and the data driver may generate analog video signal (that is, the pixel voltages described above) with opposite polarities in accordance with the change in levels of the polarity inversion signal and output the analog video signal to the pixel electrode in the liquid crystal display panel. That is to say, the positive polarity or the negative polarity of the level of the analog video signal applied to the pixel electrode is decided by the polarity inversion signal.

In the prior art, the polarity inversion signal provided to the data driver by the timing controller is unchanged, and the polarity inversion signal provided to the data driver by the timing controller cannot be changed according to different situations, which would brings many disadvantages.

For example, the existing liquid crystal display panel adopts a dot-inversion polarity driving manner to drive the data driver generally, but when such liquid crystal display panel displays images with all-white picture or all-black picture required as testing, a switching frequency of an analog video signal output subsequently is quite frequent since change of levels in the polarity inversion signal corresponding to the dot-inversion polarity driving manner is performed per sub-pixel or per pixel, which may increase a power consumption of the data driver.

SUMMARY

In view of this, the present disclosure provides a polarity inversion signal converting method, a polarity inversion signal converting apparatus and a display so as to solve a problem that the polarity inversion signal provided to the data driver cannot be changed according to different situations.

In order to solve the above-described problems, the present disclosure provides a polarity inversion signal converting method, comprising:

judging whether a polarity inversion signal is required to be converted currently and generating a judgment result;

changing the polarity inversion signal currently output to a data driver, if the judgment result indicates that the polarity inversion signal is required to be converted currently.

In an example, the step of judging whether a polarity inversion signal is required to be converted currently and generating a judgment result comprises: judging whether a preset number of frames of images with all-white picture or all-black picture are received continuously; and generating the judgment result indicating that the polarity inversion signal is required to be converted currently, when the preset number of frames of the images with all-white picture or all-black picture are received continuously and the polarity inversion signal currently output to the data driver is a first polarity inversion signal.

In an example, the step of changing the polarity inversion signal currently output to a data driver if the judgment result indicates that the polarity inversion signal is required to be converted currently comprises: adjusting a first polarity inversion signal currently output to the data driver as a second polarity inversion signal, when the judgment result indicates that the polarity inversion signal is required to be converted currently, wherein a power consumption generated by the data driver in a polarity driving manner corresponding to the second polarity inversion signal is lower than that generated by the data driver in a polarity driving manner corresponding to the first polarity inversion signal.

In an example, the step of judging whether a polarity inversion signal is required to be converted currently and generating a judgment result comprises: judging whether other images except of the images with all-white picture or all-black picture are received; and generating the judgment result indicating that the polarity inversion signal is required to be converted currently, when the other images are received and the polarity inversion signal currently output to the data driver is the second polarity inversion signal.

In an example, the step of changing the polarity inversion signal currently output to a data driver if the judgment result indicates that the polarity inversion signal is required to be converted currently comprises: adjusting the second polarity inversion signal currently output to the data driver as the first polarity inversion signal, when the judgment result indicates that the polarity inversion signal is required to be converted currently.

In an example, the polarity driving manner corresponding to the first polarity inversion signal is a dot polarity driving manner or a 1+2H dot-inversion polarity driving manner, and the polarity driving manner corresponding to the second polarity inversion signal is a column polarity driving manner.

The present disclosure also provide a polarity inversion signal converting apparatus, comprising:

a judgment module for judging whether a polarity inversion signal is required to be converted currently and generating a judgment result;

a conversion module for changing the polarity inversion signal currently output to a data driver, if the judgment result indicates that the polarity inversion signal is required to be converted currently.

In an example, the judgment module comprises:

a first processor for judging whether a preset number of frames of images with all-white picture or all-black picture are received continuously, and for generating the judgment result indicating that the polarity inversion signal is required to be converted currently, when the preset number of frames of the images with all-white picture or all-black picture are received continuously and the polarity inversion signal currently output to the data driver is a first polarity inversion signal.

In an example, the conversion module comprises:

a first converter for adjusting a first polarity inversion signal currently output to the data driver as a second polarity inversion signal, when the judgment result indicates that the polarity inversion signal is required to be converted currently, wherein a power consumption generated by the data driver in a polarity driving manner corresponding to the second polarity inversion signal is lower than that generated by the data driver in a polarity driving manner corresponding to the first polarity inversion signal.

In an example, the judgment module further comprises:

a second processor for judging whether other images except of the images with all-white picture or all-black picture are received, and for generating the judgment result indicating that the polarity inversion signal is required to be converted currently, when the other images are received and the polarity inversion signal currently output to the data driver is the second polarity inversion signal.

In an example, the conversion module further comprises:

a second converter for adjusting the second polarity inversion signal currently output to the data driver as the first polarity inversion signal, when the judgment result indicates that the polarity inversion signal is required to be converted currently.

In an example, the polarity driving manner corresponding to the first polarity inversion signal is a dot polarity driving manner or a 1+2H dot-inversion polarity driving manner, and the polarity driving manner corresponding to the second polarity inversion signal is a column polarity driving manner.

In an example, the polarity inversion signal converting apparatus is integrated into a timing controller.

The present disclosure further provides a display comprising the above polarity inversion signal converting apparatus.

The present disclosure has following beneficial effects.

The polarity inversion signals provided to the data driver may be changed according to different situations, so that the driving manners of the data driver may vary flexibly.

DETAILED DESCRIPTION

Particular implementations of the present disclosure will be described below in further details in connection with drawings and embodiments.

First Embodiment

Figure 1:
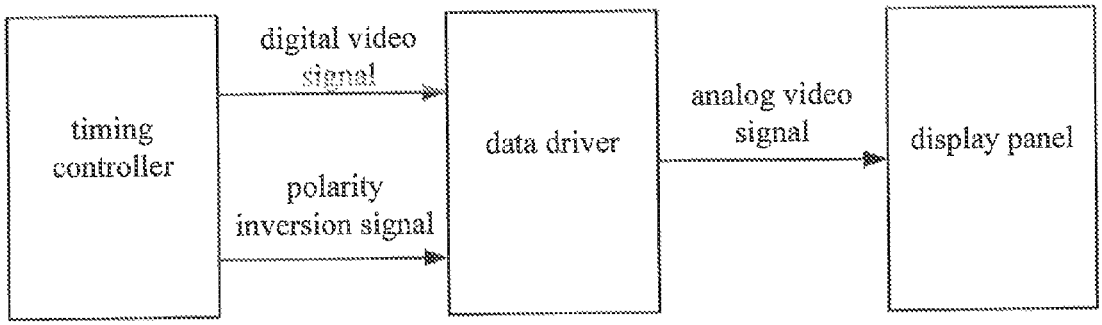
Fig.1 Prior Art
FIG. 1 is an exemplary view illustrating a structure of a driving circuit of a liquid crystal display panel in the prior art.
Figure 2:
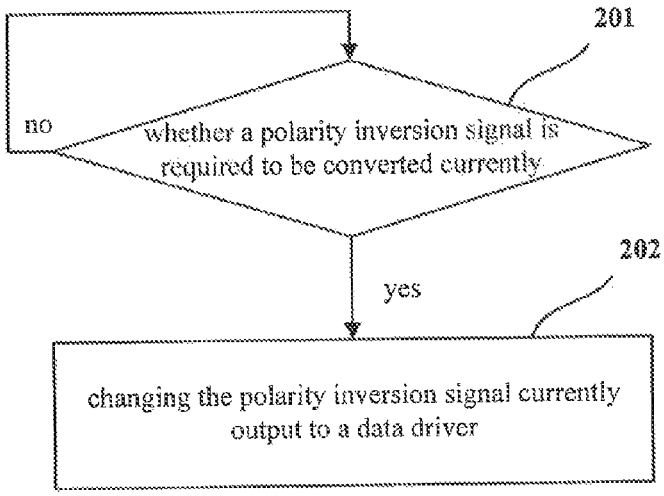
FIG. 2 is an exemplary view illustrating a flowchart of a polarity inversion signal converting method according to a first embodiment of the present disclosure.

As shown in FIG. 2, which is an exemplary view illustrating a flowchart of a polarity inversion signal converting method according to the first embodiment of the present disclosure, the polarity inversion signal converting method comprises steps as follows.

In Step 201: it is judged whether a polarity inversion signal is required to be converted currently, if yes, a step 202 is performed, and if not, the step 201 is performed repeatedly.

In Step 202: the polarity inversion signal currently output to a data driver is changed.

With the method provided in the above embodiment, the polarity inversion signals provided to the data driver may be changed according to different situations, so that the driving manners of the data driver may vary flexibly.

Thereafter the above embodiment will be described in further details by means of examples.

Existing timing controller drives the data driver generally by a dot-inversion polarity driving manner and a 1+2H dot-inversion polarity driving manner, and driving manner provided to the data driver by the timing controller is unchanged no matter which a display state a display is in, which would brings many disadvantages.

For example, a manner for displaying images with all-white picture or all-black picture continuously may be adopted usually as testing a display effect of the display, and if the dot-inversion polarity driving manner or the 1+2H dot-inversion polarity driving manner is utilized to drive the data driver when the display displays the images with all-white picture or all-black picture, a switching frequency of an analog video signal output subsequently is quite frequent since change of levels in the polarity inversion signal corresponding to the dot-inversion polarity driving manner is performed per sub-pixel or per pixel, which may increase a power consumption of the data driver.

In order to reduce the power consumption of the data driver as testing the display effect of the display, in the embodiment of the present disclosure, the driving manner of the data driver may be changed, that is, a first polarity inversion signal currently output to the data driver is adjusted as a second polarity inversion signal, when it is detected that the display effect of the display is testing, wherein the power consumption generated by the data driver in the polarity driving manner corresponding to the second polarity inversion signal is lower than that generated by the data driver in the polarity driving manner corresponding to the first polarity inversion signal.

Further, for example, if a column inversion manner is adopted currently, the column inversion manner may be converted to the dot-inversion polarity driving manner in order to reduce, or even eliminate, flickers, when the images displayed are required to be refreshed at a considerably quick speed.

Second Embodiment

Figure 3:
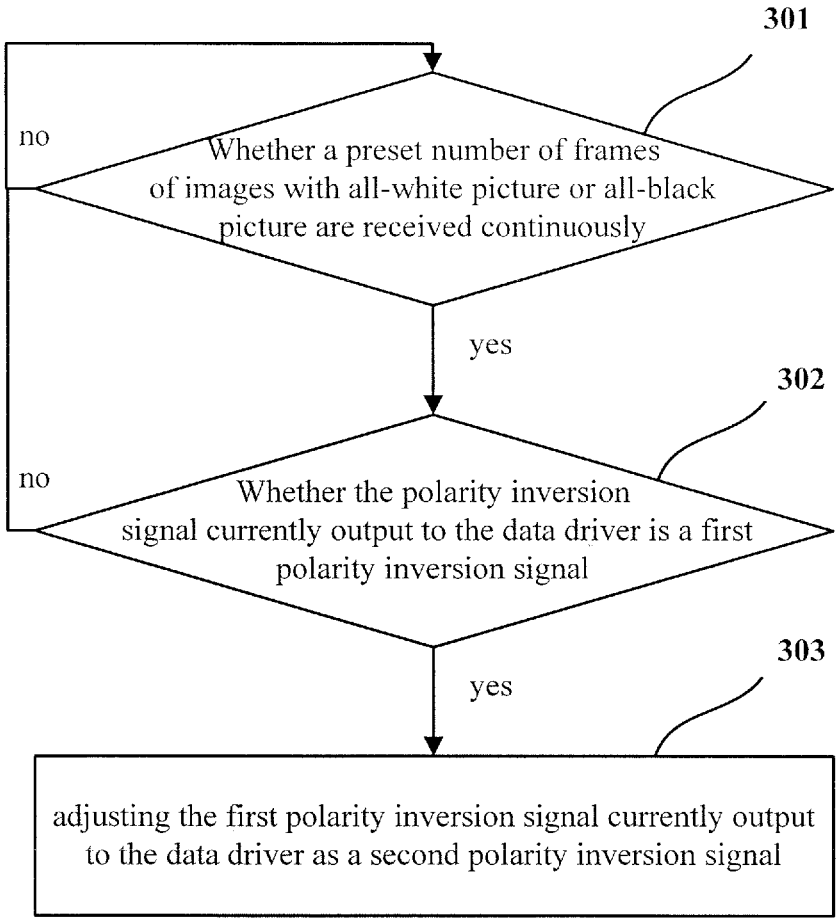
FIG. 3 is an exemplary view illustrating a flowchart of a polarity inversion signal converting method according to a second embodiment of the present disclosure.

As illustrated in FIG. 3, which is an exemplary view illustrating a flowchart of a polarity inversion signal converting method according to the second embodiment of the present disclosure, the polarity inversion signal converting method comprises steps as follows.

In Step 301, it is judged whether a preset number of frames of images with all-white picture or all-black picture are received continuously, if yes, a step 302 is performed, and if not, the step 301 is performed repeatedly.

In the present embodiment, if the preset number of frames of images with all-white picture or all-black picture are received continuously, then it indicates that the display effect of the display is testing currently.

A value of the preset number may be set depending on requirement, for example, the preset number may be 2 or 3 and the like.

In Step 302, it is judged whether the polarity inversion signal currently output to the data driver is a first polarity inversion sign, and if yes, a step 303 is performed, if not, the step 301 is performed.

In Step 303, the first polarity inversion signal currently output to the data driver is adjusted as a second polarity inversion signal, wherein a power consumption generated by the data driver in a polarity driving manner corresponding to the second polarity inversion signal is lower than that generated by the data driver in a polarity driving manner corresponding to the first polarity inversion signal.

With the method provided in the above embodiment, when the display effect of the display is testing, the polarity inversion signal output to the data driver is adjusted as the polarity inversion signal with which the data driver may generate lower power consumption as displaying the images with all-white picture or all-black picture, thus the power consumption of the data driver may be reduced.

In the above second embodiment, if other images except of the images with all-white picture or all-black picture are received, then it indicates that the testing for the display effect of the display has finished. At this time, the display may continue to use the adjusted polarity inversion signal to drive, or also may adjust the polarity inversion signal output to the data driver back in order to ensure a normal display effect.

Third Embodiment

Figure 4:
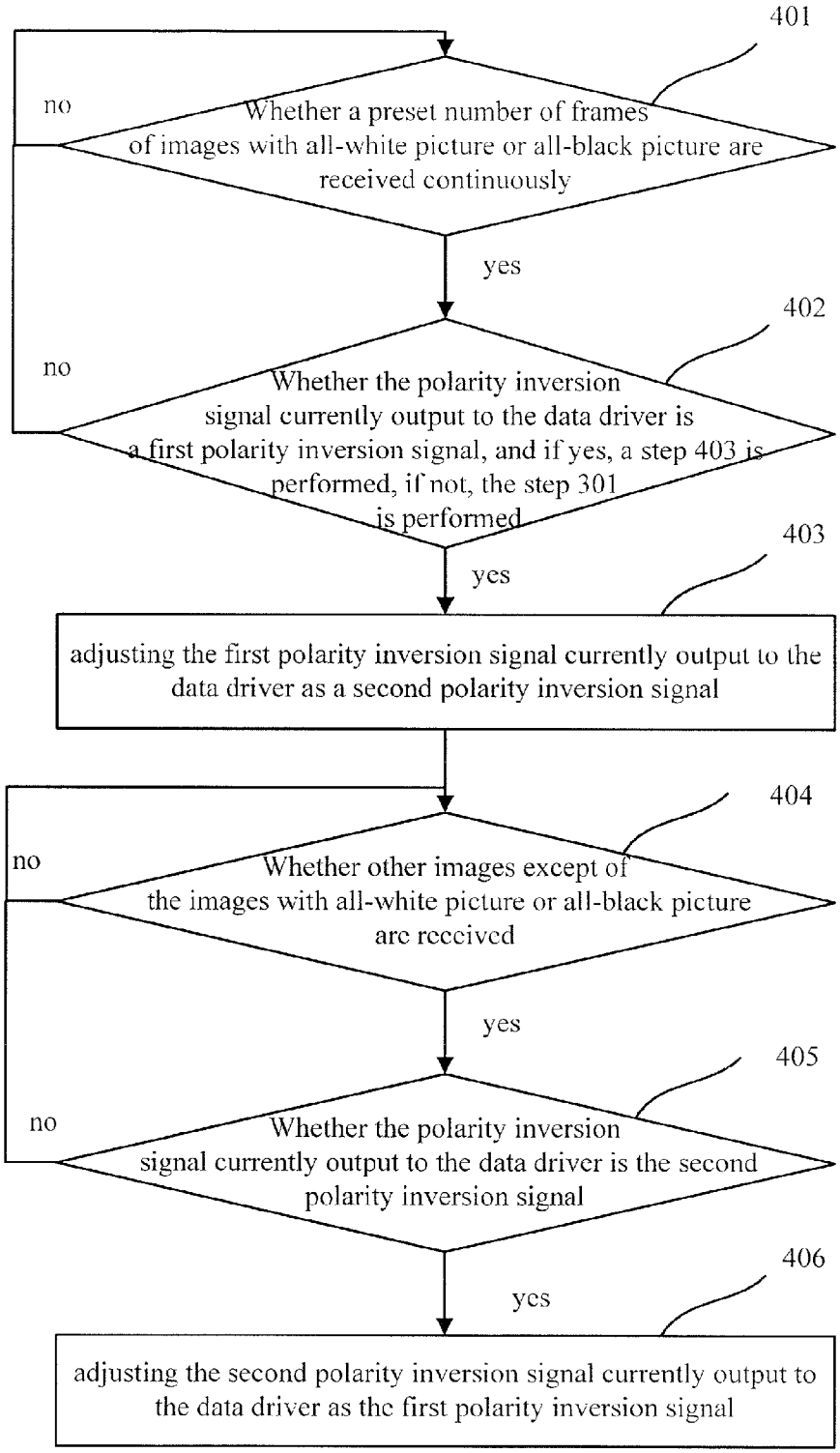
FIG. 4 is an exemplary view illustrating a flowchart of a polarity inversion signal converting method according to a third embodiment of the present disclosure.

As illustrated in FIG. 4, which is an exemplary view illustrating a flowchart of a polarity inversion signal converting method according to the third embodiment of the present disclosure, the polarity inversion signal converting method comprises steps as follows.

In Step 401, it is judged whether a preset number of frames of images with all-white picture or all-black picture are received continuously, if yes, a step 402 is performed, and if not, the step 401 is performed repeatedly.

In Step 402, it is judged whether the polarity inversion signal currently output to the data driver is a first polarity inversion signal, and if yes, a step 403 is performed, if not, the step 401 is performed.

In Step 403, the first polarity inversion signal currently output to the data driver is adjusted as a second polarity inversion signal, wherein a power consumption generated by the data driver in a polarity driving manner corresponding to the second polarity inversion signal is lower than that generated by the data driver in a polarity driving manner corresponding to the first polarity inversion signal.

In Step 404, it is judged whether other images except of the images with all-white picture or all-black picture are received, and if yes, a step 405 is performed, if not, the step 404 is performed repeatedly.

In Step 405, it is judged whether the polarity inversion signal currently output to the data driver is the second polarity inversion signal, and if yes, a step 406 is performed, if not, the step 404 is performed.

In Step 406, the second polarity inversion signal currently output to the data driver is adjusted as the first polarity inversion signal.

A polarity driving manner corresponding to the first polarity inversion signal in the above first embodiment to third embodiment may be a dot polarity driving manner or a 1+2H dot-inversion polarity driving manner, and the polarity driving manner corresponding to the second polarity inversion signal may be a column polarity driving manner (column inversion).

Figure 5:
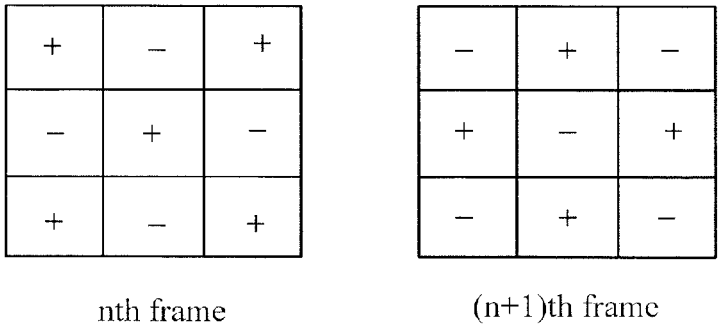
FIG. 5 is an exemplary view illustrating a dot-inversion polarity driving manner.

FIG. 5 is an exemplary view illustrating the dot-inversion polarity driving manner, wherein each sub-pixel has different polarity from its four adjacent sub-pixels at up, down, left and right, and the polarity inversion signal for the Nth image is complementary with that for the (N+1)th image.

Figure 6:
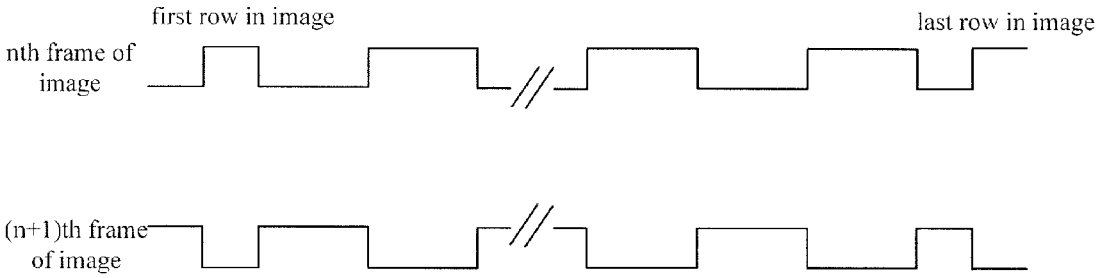
FIG. 6 is a waveform diagram of an polarity inversion signal corresponding to a 1+2H dot-inversion polarity driving manner.

FIG. 6 is a waveform diagram of the polarity inversion signal corresponding to the 1+2H dot-inversion polarity driving manner. In the 1+2H dot-inversion polarity driving manner, each pixel being composed of three sub-pixels has different polarity from its four adjacent pixels at up, down, left and right, and the polarity inversion signal for the Nth image is complementary with that for the (N+1)th image.

Figure 7:
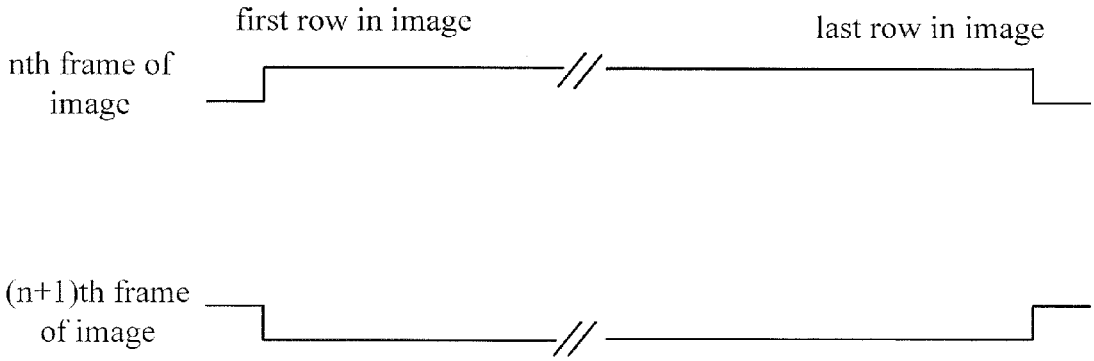
FIG. 7 is an exemplary view illustrating a column-inversion polarity driving manner.

FIG. 7 is an exemplary view illustrating the column-inversion polarity driving manner. As can be seen from FIG. 7, the polarity inversion signals corresponding to images in the two adjacent frames are continuous high level signal and continuous low level signal, respectively.

Comparing FIG. 7 with FIGS. 5, 6, it can be seen that the change of levels in the polarity inversion signal corresponding to the dot-inversion polarity driving manner is performed per sub-pixel, the change of levels in the polarity inversion signal corresponding to the 1+2H dot-inversion polarity driving manner is performed per pixel, and the polarities of voltages stored in the pixels on the same column are same in the column-inversion polarity driving manner, therefore the change of levels in the polarity inversion signal corresponding to the column-inversion polarity driving manner is performed per image in different frames. That is to say, under the driving of the column-inversion polarity driving manner, a switching frequency of an analog video signal output from the data driver is not frequent, which may reduce the power consumption of the data driver.

Of course, it is not excluded that the polarity driving manners corresponding to the first polarity inversion signal and the second polarity inversion signal are other driving manners, as long as it may ensure that the power consumption generated by the data driver in a polarity driving manner corresponding to the second polarity inversion signal is lower than that generated by the data driver in a polarity driving manner corresponding to the first polarity inversion signal. For example, the driving manner may be a frame-inversion, that is, the polarities of voltages stored in the pixels within a whole frame are same after a writing for a frame has finished and before the writing for a next frame starts.

Fourth Embodiment

Figure 8:
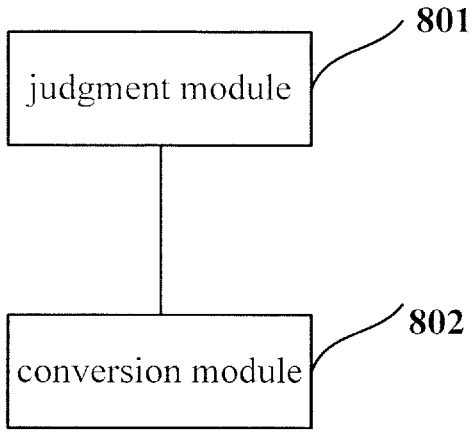
FIG. 8 is an exemplary view illustrating a structure of a polarity inversion signal converting apparatus according to a fourth embodiment of the present disclosure.

Corresponding to the first embodiment above described, the present disclosure further provide a polarity inversion signal converting apparatus, as illustrated in FIG. 8, the polarity inversion signal converting apparatus comprises:

a judgment module 801 for judging whether a polarity inversion signal is required to be converted currently and generating a judgment result;

a conversion module 802 for changing the polarity inversion signal currently output to a data driver, if the judgment result indicates that the polarity inversion signal is required to be converted currently.

With the apparatus provided in the above embodiment, the polarity inversion signal provided to the data driver may be changed according to different situations, so that the driving manners of the data driver may vary flexibly.

Fifth Embodiment

Figure 9:
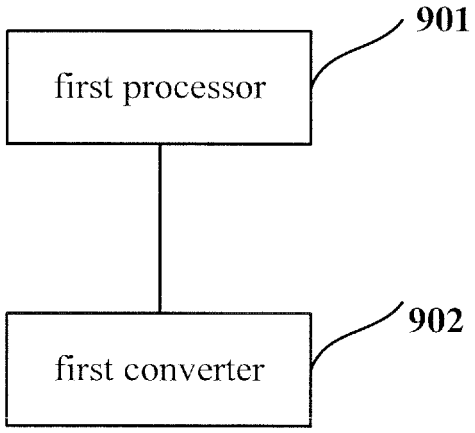
FIG. 9 is an exemplary view illustrating a structure of a polarity inversion signal converting apparatus according to a fifth embodiment of the present disclosure.

Corresponding to the second embodiment above described, the present disclosure further provide a polarity inversion signal converting apparatus, as illustrated in FIG. 9, the polarity inversion signal converting apparatus comprises:

a first processor 901 for judging whether a preset number of frames of images with all-white picture or all-black picture are received continuously, and for generating the judgment result indicating that the polarity inversion signal is required to be converted currently, when the preset number of frames of the images with all-white picture or all-black picture are received continuously and the polarity inversion signal currently output to the data driver is a first polarity inversion signal;

a first converter 902 for adjusting the first polarity inversion signal currently output to the data driver as a second polarity inversion signal, when the judgment result indicates that the polarity inversion signal is required to be converted currently, wherein a power consumption generated by the data driver in a polarity driving manner corresponding to the second polarity inversion signal is lower than that generated by the data driver in a polarity driving manner corresponding to the first polarity inversion signal.

With the apparatus provided in the above embodiment, when the display effect of the display is testing, the polarity inversion signal output to the data driver is adjusted as the polarity inversion signal with which the data driver may generate lower power consumption as displaying the images with all-white picture or all-black picture, thus the power consumption of the data driver may be reduced.

Six Embodiment

Figure 10:
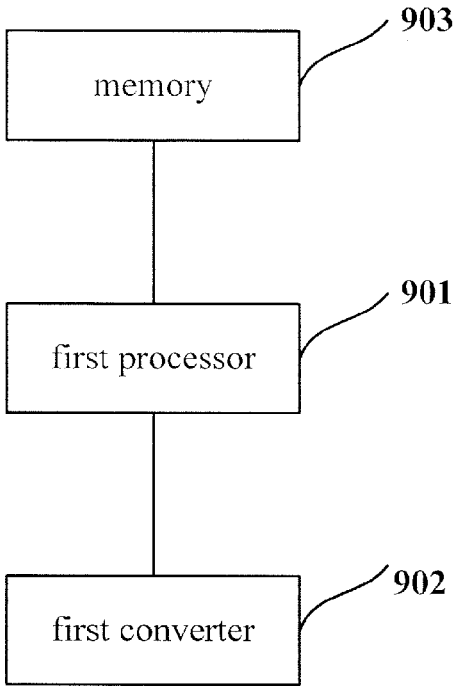
FIG. 10 is an exemplary view illustrating a structure of a polarity inversion signal converting apparatus according to a sixth embodiment of the present disclosure.

FIG. 10 is an exemplary view illustrating a structure of a polarity inversion signal converting apparatus according to the sixth embodiment of the present disclosure, wherein a memory 903 for storing a previous frame of image received may be disposed in the polarity inversion signal converting apparatus on the basis of the fifth embodiment above described. The first processor 901 compares a current frame of image currently received with the previous frame of image stored in the memory 903, performs recording if both the current frame of image and the previous frame of image are images with all-white picture or all-black picture, judges whether the polarity inversion signal currently output to the data driver is a first polarity inversion signal when a record result indicates that a preset number of frames of images with all-white picture or all-black picture are received continuously, and generates the judgment result indicating that the polarity inversion signal is required to be converted currently when the polarity inversion signal currently output to the data driver is the first polarity inversion signal.

In the above fifth or sixth embodiment, if other images except of the images with all-white picture or all-black picture are received, then it indicates that the testing for the display effect of the display has finished. At this time, the polarity inversion signal output to the data driver may be adjusted back in order to ensure a normal display effect.

Seventh Embodiment

Figure 11:
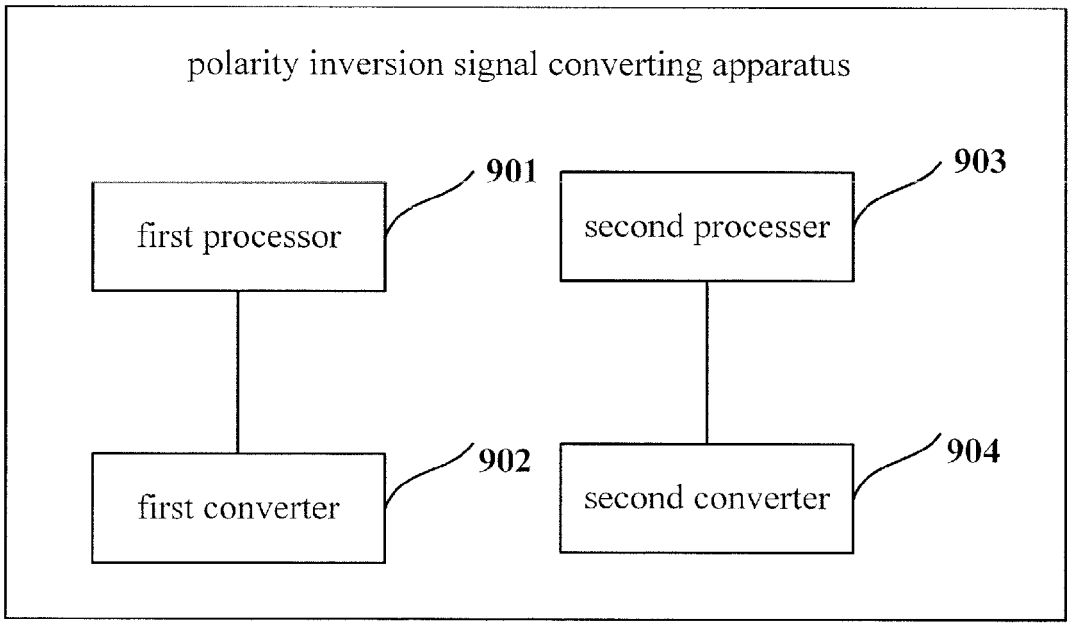
FIG. 11 is an exemplary view illustrating a structure of a polarity inversion signal converting apparatus according to a seventh embodiment of the present disclosure.

FIG. 11 is an exemplary view illustrating a structure of a polarity inversion signal converting apparatus according to the seventh embodiment of the present disclosure. In the basis of the fifth embodiment above described, the polarity inversion signal converting apparatus further comprises: a second processor 903 for judging whether other images except of the images with all-white picture or all-black picture are received, and for generating the judgment result indicating that the polarity inversion signal is required to be converted currently, when the other images are received and the polarity inversion signal currently output to the data driver is the second polarity inversion signal; a second converter 904 for adjusting the second polarity inversion signal currently output to the data driver as the first polarity inversion signal, when the judgment result indicates that the polarity inversion signal is required to be converted currently.

Of course, the polarity inversion signal converting apparatus in the seventh embodiment may also comprise the memory as illustrated in the sixth embodiment.

The polarity driving manner corresponding to the first polarity inversion signal in the above fifth embodiment to seventh embodiment may be the dot polarity driving manner or the 1+2H dot-inversion polarity driving manner, and the polarity driving manner corresponding to the second polarity inversion signal may be the column polarity driving manner or the frame polarity driving manner.

Of course, it is not excluded that the polarity driving manners corresponding to the first polarity inversion signal and the second polarity inversion signal are other driving manners, as long as it may ensure that the power consumption generated by the data driver in a polarity driving manner corresponding to the second polarity inversion signal is lower than that generated by the data driver in a polarity driving manner corresponding to the first polarity inversion signal.

The polarity inversion signal converting apparatus in the above fifth embodiment to seventh embodiment may be disposed separately, and at this time, the timing controller is connected with the data driver of the display through the converting apparatus. Further, the polarity inversion signal converting apparatus may also be integrated into the timing controller, etc.

The present disclosure further provides a display comprising a data driver, display panel and the polarity inversion signal converting apparatus as described in the above embodiments.

The above are only exemplary embodiments of the disclosed solution, but the scope sought for protection is not limited thereto. Instead, any or all modifications or replacements as would be obvious to those skilled in the art are intended to be included within the scope of the present invention. Therefore, the scope of the present invention is defined in the appended claims.

What is claimed is:

1. A polarity inversion signal converting method, comprising:

judging whether a preset number of frames of images with all-white picture or all-black picture are received continuously; and generating the judgment result indicating that the polarity inversion signal is required to be converted currently, when the preset number of frames of the images with all-white picture or all-black picture are received continuously and the polarity inversion signal currently output to the data driver is a first polarity inversion signal, adjusting the first polarity inversion signal currently output to the data driver as a second polarity inversion signal, when the judgment result indicates that the polarity inversion signal is required to be converted currently, wherein a power consumption generated by the data driver in a polarity driving manner corresponding to the second polarity inversion signal is lower than that generated by the data driver in a polarity driving manner corresponding to the first polarity inversion signal, the polarity driving manner corresponding to the second polarity inversion signal is a column polarity driving manner.

2. The polarity inversion signal converting method of claim 1, further comprising:

judging whether other images except of the images with all-white picture or all-black picture are received; and generating the judgment result indicating that the polarity inversion signal is required to be converted currently, when the other images are received and the polarity inversion signal currently output to the data driver is a second polarity inversion signal; and adjusting the second polarity inversion signal currently output to the data driver as a first polarity inversion signal, when the judgment result indicates that the polarity inversion signal is required to be converted currently, wherein a power consumption generated by the data driver in a polarity driving manner corresponding to the second polarity inversion signal is lower than that generated by the data driver in a polarity driving manner corresponding to the first polarity inversion signal.

3. The polarity inversion signal converting method of claim 1, wherein the polarity driving manner corresponding to the first polarity inversion signal is a dot polarity driving manner or a 1+2H dot-inversion polarity driving manner.

4. A polarity inversion signal converting apparatus, comprising a judgment module and a conversion module, the judgment module comprises: a first processor for judging whether a preset number of frames of images with all-white picture or all-black picture are received continuously, and for generating the judgment result indicating that the polarity inversion signal is required to be converted currently, when the preset number of frames of the images with all-white picture or all-black picture are received continuously and the polarity inversion signal currently output to the data driver is a first polarity inversion signal;

the conversion module comprises: a first converter for adjusting the first polarity inversion signal currently output to the data driver as a second polarity inversion signal, when the judgment result indicates that the polarity inversion signal is required to be converted currently, wherein a power consumption generated by the data driver in a polarity driving manner corresponding to the second polarity inversion signal is lower than that generated by the data driver in a polarity driving manner corresponding to the first polarity inversion signal, the polarity driving manner corresponding to the second polarity inversion signal is a column polarity driving manner.

5. The polarity inversion signal converting apparatus of claim 4, wherein, the judgment module further comprises: a second processor for judging whether other images except of the images with all-white picture or all-black picture are received, and for generating the judgment result indicating that the polarity inversion signal is required to be converted currently, when the other images are received and the polarity inversion signal currently output to the data driver is the second polarity inversion signal;

the conversion module further comprises: a second converter for adjusting the second polarity inversion signal currently output to the data driver as the first polarity inversion signal, when the judgment result indicates that the polarity inversion signal is required to be converted currently.

6. The polarity inversion signal converting apparatus of claim 4, wherein the polarity driving manner corresponding to the first polarity inversion signal is a dot polarity driving manner or a 1+2H dot-inversion polarity driving manner.

7. The polarity inversion signal converting apparatus of claim 4, wherein the polarity inversion signal converting apparatus is integrated into a timing controller.

8. A display comprising a polarity inversion signal converting apparatus, the polarity inversion signal converting apparatus comprises:

a judgment module and a conversion module;

the judgment module comprises: a first processor for judging whether a preset number of frames of images with all-white picture or all-black picture are received continuously, and for generating the judgment result indicating that the polarity inversion signal is required to be converted currently, when the preset number of frames of the images with all-white picture or all-black picture are received continuously and the polarity inversion signal currently output to the data driver is a first polarity inversion signal;

the conversion module comprises: a first converter for adjusting the first polarity inversion signal currently output to the data driver as a second polarity inversion signal, when the judgment result indicates that the polarity inversion signal is required to be converted currently, wherein a power consumption generated by the data driver in a polarity driving manner corresponding to the second polarity inversion signal is lower than that generated by the data driver in a polarity driving manner corresponding to the first polarity inversion signal, the polarity driving manner corresponding to the second polarity inversion signal is a column polarity driving manner.

9. The display of claim 8, wherein, the judgment module further comprises: a second processor for judging whether other images except of the images with all-white picture or all-black picture are received, and for generating the judgment result indicating that the polarity inversion signal is required to be converted currently, when the other images are received and the polarity inversion signal currently output to the data driver is the second polarity inversion signal;

the conversion module further comprises: a second converter for adjusting the second polarity inversion signal currently output to the data driver as the first polarity inversion signal, when the judgment result indicates that the polarity inversion signal is required to be converted currently.

10. The display of claim 8, wherein the polarity driving manner corresponding to the first polarity inversion signal is a dot polarity driving manner or a 1+2H dot-inversion polarity driving manner.

* * * * *